US008232488B2

(12) United States Patent
Haendler et al.

(10) Patent No.: US 8,232,488 B2
(45) Date of Patent: Jul. 31, 2012

(54) OPERATING MECHANISM FOR A SWITCHING DEVICE

(75) Inventors: Kurt Haendler, Bonn (DE); Walter Gilgen, Koenigswinter (DE)

(73) Assignee: Eaton Industries GmbH, Bonn (DE)

( * ) Notice: Subject to any disclaimer, the term of this patent is extended or adjusted under 35 U.S.C. 154(b) by 596 days.

(21) Appl. No.: 12/410,686

(22) Filed: Mar. 25, 2009

(65) Prior Publication Data

US 2009/0242361 A1 Oct. 1, 2009

(30) Foreign Application Priority Data

Mar. 29, 2008 (DE) ..... 10 2008 016 361

(51) Int. Cl.
*H01H 9/20* (2006.01)
*H01H 9/22* (2006.01)
*H01H 33/46* (2006.01)

(52) U.S. Cl. ..... 200/50.12

(58) Field of Classification Search ..... 200/50.02, 200/50.06, 50.11, 50.1, 50.12, 50.13, 50.15, 200/50.16, 43.02
See application file for complete search history.

(56) References Cited

U.S. PATENT DOCUMENTS

| | | | | |
|---|---|---|---|---|
| 1,857,711 | A * | 5/1932 | Dante | 200/50.1 |
| 3,055,996 | A * | 9/1962 | Beebe et al. | 200/50.12 |
| 4,602,136 | A | 7/1986 | Deneke et al. | |
| 4,806,710 | A * | 2/1989 | Kalvaitis et al. | 200/50.12 |
| 5,609,244 | A | 3/1997 | Reiter | |
| 7,071,427 | B2 | 7/2006 | Houck et al. | |
| 7,238,903 | B2 | 7/2007 | Fischer | |

FOREIGN PATENT DOCUMENTS

| | | | |
|---|---|---|---|
| CH | 631828 | A5 | 8/1982 |
| DE | 2304645 | A1 | 8/1974 |
| DE | 4134799 | A1 | 4/1993 |
| DE | 19519999 | A1 | 9/1996 |
| DE | 10058420 | A1 | 5/2002 |
| DE | 102006054637 | A1 | 5/2008 |
| EP | 0130727 | A2 | 1/1985 |

* cited by examiner

*Primary Examiner* — Felix O Figueroa
(74) *Attorney, Agent, or Firm* — Leydig, Voit & Mayer, Ltd.

(57) ABSTRACT

An operating mechanism, for a switch of a switching device disposed in a control cabinet having a door, includes a locking device having a locking element movable between a release position and a locking position. A spring device is configured to bias the locking element toward the release position. A force-transmitting member is operatively coupled to a resilient control member of the door, the force-transmitting member being configured to actuate the locking element.

23 Claims, 2 Drawing Sheets

OPERATING MECHANISM FOR A SWITCHING DEVICE

CROSS REFERENCE TO RELATED APPLICATION

Priority is claimed to German Patent Application No. DE 10 2008 016 361.9, filed Mar. 29, 2008.

FIELD

The present invention relates to an operating mechanism for a switch of a switching device. In particular, the present invention relates to a switching device mounted in a control cabinet provided with a door and has a locking device for a switch, said locking device being accommodated in a rotary operating mechanism and having a locking element which is actuatable by a force-transmitting member and is movable between a release position and a locking position.

BACKGROUND

Electrical control cabinets having switching devices mounted therein are well-known in the art. The known control cabinets include a housing and a door mounted to said housing. Switching devices are mounted in the control cabinet housing. To be able to operate the switches of the switching devices in a control cabinet that is closed, the doors have switches mounted thereon which are operatively connected via shafts or axles to the switching devices in the control cabinet. The switch operating movements and positions are transmitted by the shafts to the rotary operating mechanisms of the switching device in the control cabinet.

U.S. Pat. No. 7,238,903 describes the construction of a control cabinet having an operating mechanism. This control cabinet is well-known in the art. To be able to operate the switching device even when the door is open, it is proposed to provide an auxiliary lever, which is mounted in the control cabinet housing on the shaft that transmits the force of the external operating lever to the switching device. If the switching device is turned off before the door is opened, it can be turned on again at any time using the auxiliary lever. There is no safeguard to prevent the switching device from being inadvertently turned on while the control cabinet is open.

U.S. Pat. No. 7,071,427 describes an auxiliary handle which is mounted on a shaft of the switching device and is rotatable in the OFF direction, while in the ON direction, it requires an additional movement to be carried out in the direction of extension of the axis of the shaft. Here, the problem of inadvertent turn-on is solved by an additional movement of the auxiliary handle in the axial direction. However, the solution described is very complex and the mass of the auxiliary handle is increased by the coupling means required. Among other things, this has a negative effect on the bearings in the rotary operating mechanism, because the weight bends the shaft downward.

German document DE 41 34 799 describes operating a switching device mounted in a control cabinet by means of an externally mounted push switch. The force applied by operating the push switch is transmitted by a Bowden cable to a pressing means on the switching device. There are no safety mechanisms to prevent inadvertent turn-on.

German document DE 100 58 420 describes a Bowden cable operated locking device in a control cabinet.

SUMMARY

It is an aspect of the present invention to provide a simply constructed operating mechanism for a switching device mounted in a control cabinet, which will prevent the switching device from being inadvertently turned on while the control cabinet door is open.

In an embodiment, the present invention provides an operating mechanism for a switch of a switching device disposed in a control cabinet having a door. The operating mechanism includes a locking device having a locking element movable between a release position and a locking position. A spring device is configured to bias the locking element toward the release position. A force-transmitting member is operatively coupled to a resilient control member of the door, the force-transmitting member being configured to actuate the locking element.

BRIEF DESCRIPTION OF THE DRAWINGS

Further advantages, special features and expedient embodiments of the present invention will become apparent from the following exemplary embodiments that are described with reference to the accompanying figures in which.

DETAILED DESCRIPTION

Figure 1:
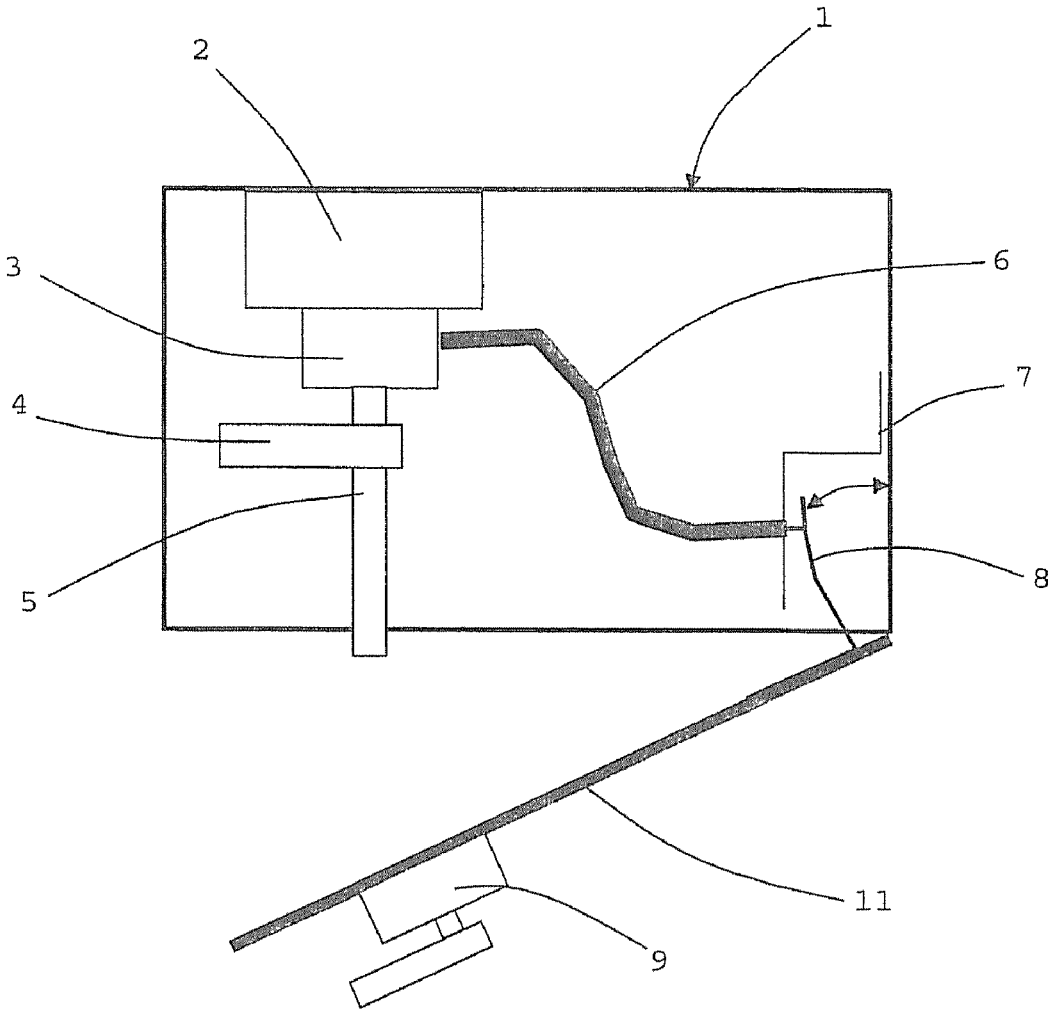
FIG. 1 is a schematic view of a specific embodiment of the operating mechanism according to an embodiment of the present invention.

The present invention is directed to an operating mechanism for the switch of a switching device which is mounted in a control cabinet provided with a door. The switching device has a locking device for the switch, said locking device having a locking element which is actuatable by a force-transmitting member and is movable between a release position and a locking position. An aspect of the present invention provides that the movement of the locking element toward the release position is biased by a spring means, and that the force-transmitting member is operatively connected to a resilient control member of the door of the control cabinet. It has proven advantageous for the force-transmitting member to be in the form of a Bowden cable.

It has also proven to be advantageous that the control member be formed of a flat spring which is operatively connected to the force-transmitting member.

Advantageously, the locking element locks the switch only in the OFF position.

It is advantageous that the locking element be movable from the locking position to the release position by hand against the spring force of the control member.

In another, advantageous embodiment of the present invention, the force-transmitting member is fixedly mounted on the control cabinet by mounting means. It has proven advantageous for the control member to be fixedly mounted on the door of the control cabinet.

One advantage of the present invention is that it couples a turn-on blocking means of a switching device to the position of a control cabinet door relative to the control cabinet, while at the same time allowing the use of existing control cabinet designs. When the control cabinet door is in the closed position, no force is exerted on the locking element via the force-transmitting member. Because the spring means hold the locking element in the release position, the switch of the control cabinet can be turned on and off via the door-mounted operating lever.

Once the control cabinet door is opened, the locking element locks the switch in the OFF position. The switch can only be returned to the ON position by an additional, deliberate action (operation of a manual actuating means). This prevents inadvertent turn-on and reduces the risk of injuries caused by electric shocks. If the switch of the switching device is in the ON position when the door is opened, the switching device can be moved directly to the OFF position by rotating the axle using an auxiliary lever, without allowing any additional action to be carried out. In this function, the operating mechanism complies with UL requirements.

Another advantage is that the simple design of the operating mechanism of the present invention allows adaptation to different door systems. By suitably modifying and adapting the control member, it is also possible to use sliding doors in place of the door shown here.

Since there is no need to provide an additional device on the axle or shaft of the switching device, there is no additional load on the rotary operating mechanism, and thus, the reliability and service life of the switching device are improved. The use of a Bowden cable as the force-transmitting member allows variable positioning within the control cabinet. Because a Bowden cable provides flexible transmission of force, a switching device may be disposed in the control cabinet at any position relative to the control cabinet door.

FIG. 1 shows the construction of an inventive operating mechanism for a switching device 2 in a schematic view. A switching device 2 is mounted in a control cabinet 1 having a door 11 on one side. Switching device 2 is located on the inner wall of control cabinet 1 which is opposite door 11. Mounted to the switching device 2 is a rotary operating mechanism 3 which includes a mechanism for turning switching device 2 on and off. An axle 5 is connected to rotary operating mechanism 3 and extends to door 11. A door-mounted operating lever 9 is disposed on the exterior of door 11.

Door-mounted operating lever 9 is operatively connected to axle 5 once door 11 of control cabinet 1 is closed. Using door-mounted operating lever 9, switching device 2 can be turned on and off while door 11 is in the closed position. This is accomplished by axle 5 transmitting the movement of door-mounted operating lever 9 to rotary operating mechanism 3.

Figure 2:
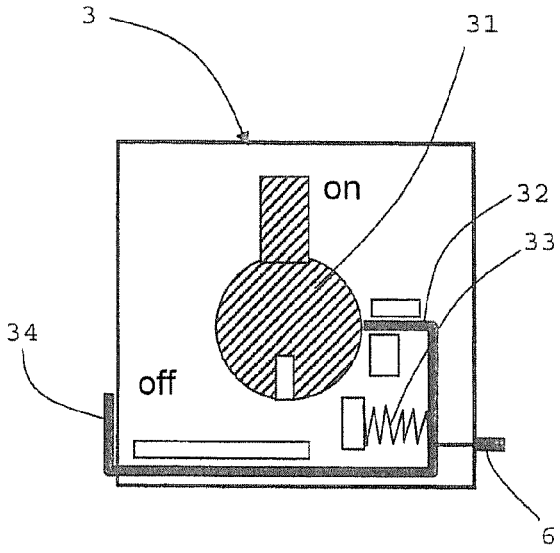
FIG. 2 is a schematic view showing the rotary operating mechanism of the operating mechanism in the ON position and in the released position.
Figure 3:
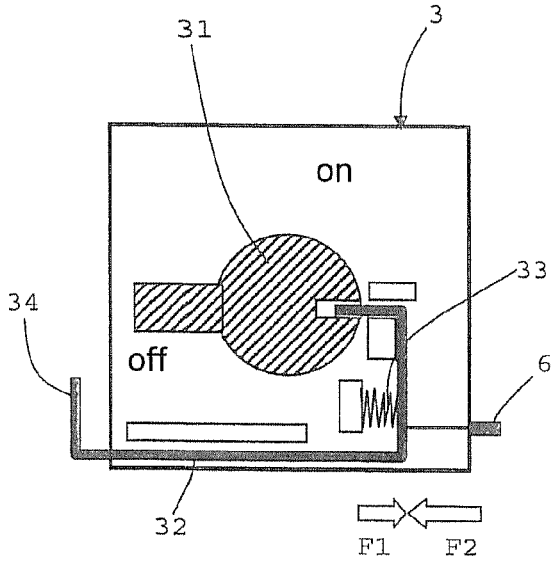
FIG. 3 is a schematic view showing the rotary operating mechanism of the operating mechanism in the OFF position and in the locked position.
Figure 4:
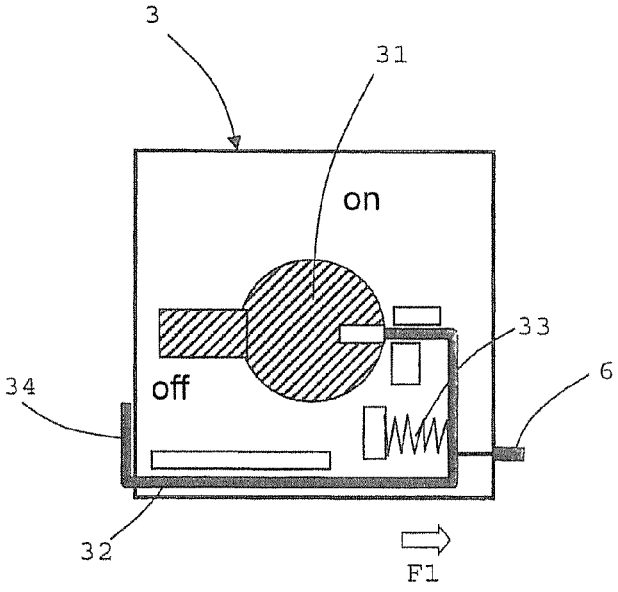
FIG. 4 is a schematic view showing the rotary operating mechanism of the operating mechanism in the OFF position and in the released position.

Mounted on axle 5 is an auxiliary lever 4 which allows axle 5 to be rotated while door 11 is in the open position. Rotary operating mechanism 3 has a switch 31 which is connected to axle 5 and allows manual operation of the switching device. Switch 31 is operatively connected to a locking element 32. Locking element 32 is held in the release position by a spring means 33, because spring means 33 exerts a force F1 in the release direction (FIG. 2). If no additional force is applied, locking element 32 is retained in the release position, so that switch 31 can be moved between the ON and OFF positions (FIGS. 2 and 4).

A force-transmitting member 6 in the form of a Bowden cable is also operatively connected at a first end to locking element 32. The other end of force-transmitting member 6 is supported on control cabinet 1 by a mounting means 7 in such a way that a force at this end can be transmitted to locking element 32. In the embodiment using a Bowden cable, the core of the Bowden cable is freely movable and the casing of the Bowden cable is fixedly attached to mounting means 7 and to rotary operating mechanism 3. A control member 8 in the form of a flat spring is attached to door 11 in such a way that it exerts a force on force-transmitting member 6 as door 11 is opened. In this exemplary embodiment, the flat spring presses against the core of Bowden cable 6 when door 11 is being opened. The farther door 11 is opened, the greater becomes force F2 which is exerted by control member 8 on locking element 32 via force-transmitting member 6.

When switch 31 is in the ON position, locking element 32 is blocked in the release position and cannot be moved to the locking position (FIG. 2). In that condition, the force F2 exerted by control member 8 on force-transmitting member 6 acts on control member 8 and elastically deforms the flat spring which forms the control member 8. When switch 31 is moved to the OFF position while door 11 is in the open position, force F2 acts on locking element 32 against the force F1 exerted by spring means 33.

If, when switching device 2 is OFF, force F2 is greater than force F1, locking element 32 is moved to the locking position in which it locks switch 31, and thus, switching device 2 in the OFF position. The flat spring used as control member 8 should be designed such that when door 11 is open to an extent which allows the terminals of switching device 2 be accessed from outside, spring force F2 will be greater than spring force F1.

When locking element 32 is in the locking position, locking element 32 can be returned to the release position against force F2 of the flat spring using a manual actuating means 34, and switch 31 can be rotated from the OFF position to the ON position. Operation of manual actuating means 34 causes the flat spring forming control member 8 to deform.

The present invention is not limited to the embodiments described herein; reference should be had to the appended claims.

LIST OF REFERENCE NUMERALS

1 control cabinet
11 door
2 switching device
3 rotary operating mechanism
31 switch
32 locking element
33 spring means
34 manual actuating means
4 auxiliary lever
5 axle
6 force-transmitting member
7 mounting means
8 control member
9 door-mounted operating lever
F1 spring force of the spring means
F2 spring force of the control member

What is claimed is:

1. An operating mechanism for a switch of a switching device disposed in a control cabinet having a door, the operating mechanism comprising:

a locking device having a locking element movable between a release position and a locking position;

a spring device configured to bias the locking element toward the release position; and a force-transmitting member operatively coupled to a resilient control member of the door, the force-transmitting member being configured to actuate the locking element.

2. The operating mechanism as recited in claim 1, wherein the force-transmitting member is operatively coupled with the resilient control member at a first end and operatively coupled to the spring device at a second end.

3. The operating mechanism as recited in claim 1, wherein the force-transmitting member is fixedly disposed on the control cabinet via mounting elements.

4. The operating mechanism as recited in claim 3, wherein the control member is fixedly disposed on the door of the control cabinet.

5. The operating mechanism as recited in claim 1, wherein the locking element is movable from the locking position to the release position against a spring force of the control member.

6. The operating mechanism as recited in claim 5, wherein the force-transmitting member is fixedly disposed on the control cabinet via mounting elements.

7. The operating mechanism as recited in claim 5, wherein the control member is fixedly disposed on the door of the control cabinet.

8. The operating mechanism as recited in claim 1, wherein the locking element is configured to lock the switch only in an OFF position thereof.

9. The operating mechanism as recited in claim 8, wherein the locking element is movable from the locking position to the release position against a spring force of the control member.

10. The operating mechanism as recited in claim 8, wherein the force-transmitting member is fixedly disposed on the control cabinet via mounting elements.

11. The operating mechanism as recited in claim 8, wherein the control member is fixedly disposed on the door of the control cabinet.

12. The operating mechanism as recited in claim 1, wherein the control member includes a flat spring operatively coupled to the force-transmitting member.

13. The operating mechanism as recited in claim 12, wherein the locking element is configured to lock the switch only in an OFF position thereof.

14. The operating mechanism as recited in claim 12, wherein the locking element is movable from the locking position to the release position against a spring force of the control member.

15. The operating mechanism as recited in claim 12, wherein the force-transmitting member is fixedly disposed on the control cabinet via mounting elements.

16. The operating mechanism as recited in claim 12, wherein the control member is fixedly disposed on the door of the control cabinet.

17. The operating mechanism as recited in claim 1, wherein the force-transmitting member includes a Bowden cable.

18. The operating mechanism as recited in claim 17, wherein the control member includes a flat spring operatively coupled to the force-transmitting member.

19. The operating mechanism as recited in claim 17, wherein the locking element is configured to lock the switch only in an OFF position thereof.

20. The operating mechanism as recited in claim 17, wherein the locking element is movable from the locking position to the release position against a spring force of the control member.

21. The operating mechanism as recited in claim 17, wherein the force-transmitting member is fixedly disposed on the control cabinet via mounting elements.

22. The operating mechanism as recited in claim 17, wherein the control member is fixedly disposed on the door of the control cabinet.

23. The operating mechanism as recited in claim 1, wherein the control member is fixedly disposed on the door of the control cabinet.

* * * * *